United States Patent [19]

Cox et al.

[11] Patent Number: 4,534,499

[45] Date of Patent: Aug. 13, 1985

[54] WIRE DRIVE MECHANISM

[76] Inventors: Ron Cox, 2208 Victoria St., Windsor, Ontario, Canada; Elzi Pettovello, 6326 Appoline Dr., Dearborn, Mich. 48126

[21] Appl. No.: 460,711

[22] Filed: Jan. 24, 1983

[30] Foreign Application Priority Data

Jan. 29, 1982 [CA] Canada ..... 395204

[51] Int. Cl.[3] ..... G03D 3/12

[52] U.S. Cl. ..... 226/184; 226/176

[58] Field of Search ..... 226/176, 177, 183, 184, 226/187, 193, 194, 199; 242/73, 68.4

[56] References Cited

U.S. PATENT DOCUMENTS

| | | | |
|---|---|---|---|
| 674,136 | 5/1901 | Huhn et al. | 226/177 |
| 720,141 | 2/1903 | Hayes | 242/68.4 |
| 935,494 | 9/1909 | Griffin | 242/68.4 |
| 1,515,382 | 11/1924 | Cheesman | 242/68.4 |
| 1,924,088 | 8/1933 | Bowles | 242/55.2 |
| 2,130,698 | 9/1938 | Preston | 226/199 X |
| 2,681,401 | 8/1950 | Anderson | 226/177 |
| 3,009,619 | 8/1957 | Layden | 226/184 |
| 3,185,366 | 5/1965 | Charlop | 226/184 X |
| 3,830,419 | 8/1974 | Lee | 226/184 |
| 3,921,419 | 11/1975 | Rosenkranz | 226/184 X |

*Primary Examiner*—Stephen Marcus
*Assistant Examiner*—Leo J. Peters
*Attorney, Agent, or Firm*—Jones, Tullar & Cooper

[57] ABSTRACT

The specification describes a mechanism for controllably advancing material such as wire to a work station. The mechanism includes two frusto-conical shaped wheels mounted in a face to face relationship so that the wire is pulled through the nip formed by a rotation of the wheels. One wheel has an associated bias adjustment means which is adapted to vary the pressure exerted by one wheel on the other. A flexible wire guide, and an adjustable spool holder form part of the mechanism.

9 Claims, 3 Drawing Figures

WIRE DRIVE MECHANISM

This invention relates to a drive mechanism for controllably advancing a wire or similar elongate object to a work station such as a spot welder. The drive mechanism includes a wire spool holder, a wire guide and two conically shaped drive wheels which are adjusted to clamp, and controllably advance the wire or elongate object therebetween.

In operations such as spot welding it is frequently advantageous to supply wires of different diameters to the work station. The wire is conventionally supplied on spools which have a centrally disposed cylindrical opening. Usually, the diameter of the spool and indeed the width are related to the diameter of the wire wound thereon. A small diameter wire is usually wound on a smaller spool than might be used for a larger diameter wire. One of the features of this invention provides a simple but effective manner whereby different spool sizes may be used in connection with the spot welder without complex set-up changes. A further difficulty encountered by the use of different wire sizes in a spot welding operation relates to holding and advancing the wire in a precise manner to the work station. Means to drive a wire of a specific diameter are, of course, known. The present invention, however, contemplates the use of a variety of diameters of wires, and a holding and driving means is provided which readily accommodates the various wire diameters without requiring complex equipment change. A flexible wire guide is located between the spool holder and wire drive mechanism, the purpose of which is self explanatory.

Therefore, in accordance with the present invention there is provided a drive mechanism for advancing an elongate object, for example a wire, to a work station, such as a spot welder. The drive mechanism comprises a pair of frusto-conical shaped wheels mounted so as to engage said object therebetween. The wheels are mounted for rotation on separate shafts so that each frusto-cone is in a face to face relationship with the other. Drive means are associated with a first wheel so that wheel is caused to rotate thereby. Idler means associated with the shaft of the second wheel communicates with the drive means to cause the second wheel to rotate in a direction opposite to the rotational direction of the first wheel. The shaft of the second wheel extends beyond the wheel and a tension adjusting means in the form of a coil spring surrounding the shaft and an adjusting nut threadedly engaging the shaft is provided. The tension adjusting means is provided so that a wire or other elongate object entrapped between the conical-shaped wheels is securely held thereby. The adjustment, of course, provides means whereby the drive mechanism can accommodate various diameter wires. Rotation of the wheels forms a nip therebetween and causes the elongate object to be pulled or advanced through.

The drive mechanism may also include an adjustable spool holder comprising a pair of cone-shaped elements opposingly mounted on a common shaft, so that the spool may be rotatably secured therebetween. The distance between the cones may be adjusted as required to accommodate spools of different widths.

In a further embodiment of the present invention a flexible wire guide is located between the drive wheels and the spool holder so as to align the wire wheels and to minimize bends and kinks in the wire.

The aforementioned features of the present invention will be understood from the following detailed description in conjunction with the accompanying drawings wherein.

Figure 1:
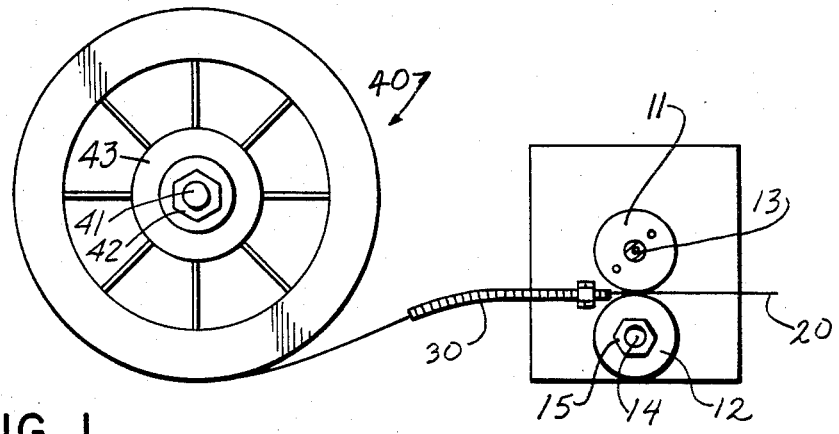
FIG. 1 is an elevational view of the drive mechanism in accordance with the present invention.

The preferred embodiment of the present invention, as illustrated in FIG. 1 includes a pair of frusto-conically shaped wheels 11 and 12. The wheels as illustrated are mounted on shafts 13 and 14 is respectively. Shaft 14 associated with wheel 12, projects through the wheel, and is fitted with a bias adjusting nut 15, on the outer end. Wheel 11 is inscribed with a circumferential groove 16 at or near the mid-point of the face 11' of the cone. The groove may have a rounded cross-section or may be a V groove. Wheel 11 has a gear 17 positioned on the base side of the cone, and is attached to the shaft 13. A drive motor (not shown) is attached to the shaft 13 by any suitable means whereby the shaft gear 17 and conical wheel 11 may be controllably rotated. The gear 17 is seen to cooperate with a second gear 18 attached to the shaft 14 on which wheel 12 is connected. Gear 17 when rotated produces a rotation of second gear 18 which in turn causes the second conical wheel 12 to rotate. As is understood, the second wheel 12 will rotate in the opposite direction to wheel 11.

Figure 2:
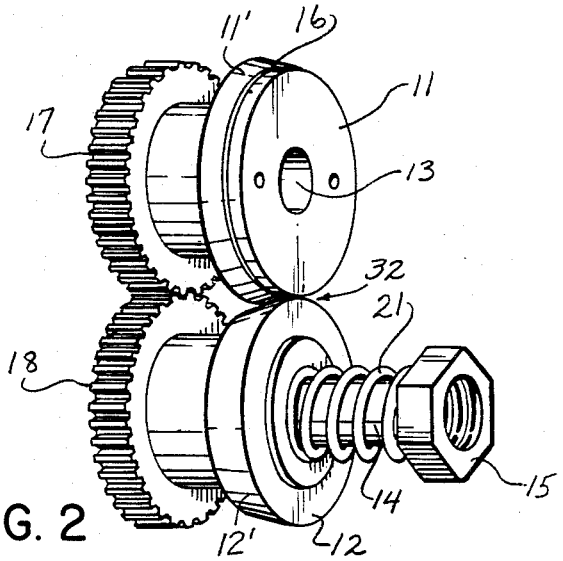
FIG. 2 illustrates, perspectively, the cone shaped drive wheels.

As illustrated in FIG. 2, conical wheel 11 is mounted with the base of the cone towards the gear 11 and the apex facing outwardly. Wheel 12 is oppositely mounted with the base of the cone facing outwardly and the apex facing the gear side. In this way, as will be apparent from FIG. 2 the beveled surfaces 11' and 12' of the conical wheels are in face to face contact. Wire 20 is located in groove 16 and entrapped therein by the biasing means shown in FIG. 2 as a helical spring 21. Adjusting nut 14 is threaded onto shaft 14 and is positionable to vary the pressure on the biasing means 21 and thus adjusts the force applied by the wheels 11 and 12 on the wire held therebetween. As will be apparent, adjustment of the nut and hence compression of the biasing means will serve to accommodate various diameter wires, fed to the drive means. The wheels may be machined from aluminium, stainless steel or other suitable materials.

The wheels illustrated in FIG. 2 and the previous discussion contemplate generally smooth faces 11' and 12', with a circumferential groove centrally located in the face of one of the wheels. It is to be understood that other means of improving the frictional force exerted on the wire may be employed. Such other means include serrations 22 as shown in FIG. 4 on drive wheel 12, or knurling 24 as shown in FIG. 5 on drive wheel 12. Although shown only on face 12' in each case, the serrations 22 or knurling 24 may also be included on face 11', either instead of face 12' or in addition thereto.

A flexible wire guide 30 is secured to the mounting arrangement in such a way that an elongate object such as wire 20 is directed to the nip 32 formed by the two rotating wheels 11 and 12. More specifically, the guide is positioned so that wire 20 is directed to groove 16 formed circumferentially in wheel 11. Thus the wire 20 is entrapped between the wheels and fed to a subsequent work station (not shown) in controlled manner. The guide also serves to minimize bends and kinks in the wire as it is fed to the drive wheels.

Figure 3:
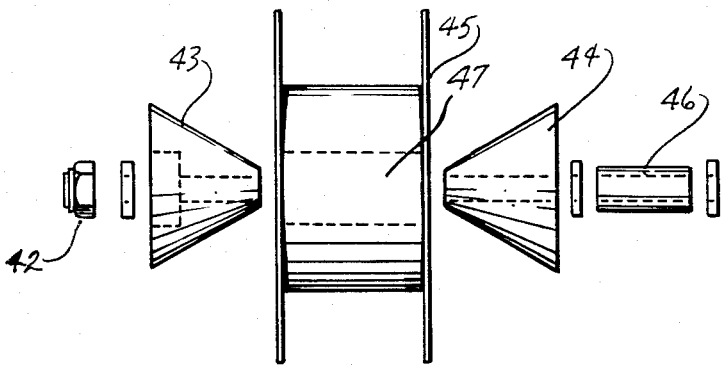
FIG. 3 is a cross-sectional view of the adjustable spool holder.

A spool holder 40 illustrated in FIGS. 1 and 3 is adapted to rotatably hold a wire spool in a position whereby wire may be advanced to and through drive wheels 11 and 12. The holder 40 includes a shaft 41 attached by any suitable means such as welding or threaded engagement to the support structure (not shown). The shaft projects from the support structure substantially parallel to the two shafts which carry the drive wheels 11 and 12. The outer end of the shaft is threaded so as to threadedly receive a retaining nut 42. Between the support structure (not shown) and the retaining nut 42 combinations of spacers and cones are rotatably located on the shaft. Specifically, outer cone 43, and inner cone 44 provide a rotating surface for the axial opening 47 in the wire spool 45. To accommodate spools of different widths, as might be used for wire of different diameters, suitable spacers such as shown in FIG. 3 by reference numeral 46 are provided. For example, for spools with a width of 4 inches, cone 43 is used in conjunction with spacer 46. Spools having a width of 8 inches are held by inner cone 44 and outer cone 43 with no spacers, and spools having a width of 12 inches may be held by inner cone 44, outer cone 43 and spacer 46 in a manner illustrated in FIG. 3.

Although the spool advantageously is free to rotate so that as the wire is pulled through the drive wheels additional wire may be unwound from the spool, it is undesirable, of course, for an excess of wire to be unwound as this will unavoidably result in kinks and bends in the loose wire. Accordingly, the retaining nut 42 should be tightened sufficiently to cause a drag on the spool as it rotates. This drag or friction on rotating surfaces acts as a brake to the spool.

In operation, a wire of the selected diameter will be pre-wound on a spool of a particular width. The spool is positioned between the cones and spacers in a manner whereby the spool may controllably rotate about the mounting shaft. The free end of the wire is fed through the wire guide which in turn is positioned such that the wire is directed to the nip formed by the conical drive wheels and aligned with the groove in one of the wheels. As the wheels are caused to rotate, the wire is controllably advanced by the wheels and directed to a subsequent work station. A wire of a different diameter may be fed to a work station with a minimum of changes to the drive mechanism. The cone arrangement associated with the spool holder is changed in the manner previously described. The free end of the wire is directed to the nip of the drive wheels, and the bias applied to one of wheels is adjusted until the wire may be controllably advanced therebetween.

The embodiments of the invention in which an exclusive property or privilege is claimed are defined as follows:

1. A drive mechanism for use in advancing an elongate object to a work station, comprising:

first and second separate, parallel shafts;

first and second frusto-conically shaped drive wheels mounted on said first and second shafts, respectively, each said drive wheel having a base, an apex, and a beveled face extending therebetween, said drive wheels being oppositely mounted on said shafts whereby the bases of said wheels face outwardly from each other and the apexes of said wheels face inwardly toward each other, said wheels being mounted in a face-engaging relationship to define a nip therebetween;

drive means coupled to said first drive wheel shaft to impart a rotational force to said first drive wheel;

idler means mounted on said second drive wheel shaft and coupled to said second drive wheel and cooperating with said drive means to impart to said second drive wheel a rotational force opposite to said rotational force of said first drive wheel;

resilient bias means mounted on and coaxial with said second shaft and engaging said second drive wheel to resiliently bias the face of said second drive wheel toward the face of said first drive wheel to provide a resilient gripping force between said drive wheels at said nip whereby elongate objects of different diameters fed into said nip will be resiliently gripped by and pulled between said first and second drive wheels as said drive wheels are caused to rotate; and means threadedly mounted on said second shaft and engaging said bias means for adjusting said bias means to vary said gripping force at said nip.

2. A drive mechanism according to claim 1, wherein one of said first and second drive wheels has a circumferential groove inscribed in the face thereof.

3. A drive mechanism according to claim 1, wherein at least one of said first and second drive wheels is provided with serrations on the face thereof.

4. A drive mechanism according to claim 1, wherein at least one of said first and second drive wheels is provided with knurlings on the face thereof.

5. A drive mechanism in accordance with claim 1, wherein said idler means and said drive means are gears.

6. A drive mechanism according to claim 1, further including:

a spool for holding a supply of said elongate object, said spool having an axial opening;

adjustable holder means for receiving and securing said spool, said holder means including a spool shaft and first and second cone-shaped elements mounted on said spool shaft, said cone-shaped elements being moveable along said spool shaft to engage said spool to provide a rotating surface for said spool axial opening; and retaining means on said spool shaft for positioning said cone-shaped elements on said spool shaft, said retaining means being adjustable to produce a controllable drag on said spool as it rotates whereby said cone-shaped elements control the rotation of said spool; and guide means located between said spool and said drive wheels for directing an elongate object from said spool to said pair of drive wheels.

7. A drive mechanism according to claim 6, further including guide means located between said spool holder and said drive wheels to feed said elongate object into said nip.

8. A drive mechanism according to claim 7, wherein said guide is flexible.

9. A drive mechanism according to claim 8, wherein said elongate object is wire.

* * * * *